United States Patent [19]

Endel et al.

[11] Patent Number: 4,550,459

[45] Date of Patent: Nov. 5, 1985

[54] ORTHOPEDIC PILLOW

[75] Inventors: Dieter Endel, Konstanz; Gerd Billerbeck, Wuppertal, both of Fed. Rep. of Germany

[73] Assignee: IBU Betten-Union GmbH & Co. KG, Wuppertal, Fed. Rep. of Germany

[21] Appl. No.: 498,630

[22] Filed: Aug. 8, 1983

[30] Foreign Application Priority Data

May 28, 1982 [DE] Fed. Rep. of Germany ..... 3220336

[51] Int. Cl.[4] ..... A47G 9/00

[52] U.S. Cl. ..... 5/437; 5/436

[58] Field of Search ..... 5/437, 434, 436, 441, 5/442

[56] References Cited

U.S. PATENT DOCUMENTS

| | | | |
|---|---|---|---|
| Re. 17,607 | 2/1930 | Lange | 5/442 |
| 247,892 | 10/1881 | Doremus | 5/442 |
| 395,043 | 12/1888 | Doremus | 5/442 |
| 3,648,308 | 3/1972 | Greenwalt | 5/436 |
| 3,849,810 | 11/1974 | Degen | 5/442 |
| 4,393,530 | 7/1983 | Stark | 5/436 |
| 4,424,599 | 1/1984 | Hannouche | 5/434 |
| 4,432,107 | 2/1984 | Clark et al. | 5/436 |

FOREIGN PATENT DOCUMENTS

| | | | |
|---|---|---|---|
| 1827502 | 3/1961 | Fed. Rep. of Germany . | |
| 6750491 | 1/1969 | Fed. Rep. of Germany . | |
| 6900803 | 6/1969 | Fed. Rep. of Germany | 5/465 |
| 8101524 | 11/1981 | Fed. Rep. of Germany | 5/436 |

*Primary Examiner*—Alexander Grosz

*Attorney, Agent, or Firm*—Cushman, Darby & Cushman

[57] ABSTRACT

The work habits and lifestyles of the present day, with the stereotyped bent posture of the head, result in a shortening of the corresponding muscle parts. To achieve regeneration during sleep, an orthopedic pillow is provided, and this has in the lower region a thickened portion for supporting the region of the cervical vertebrae, slight expansion of the shortened muscle groups being obtained.

1 Claim, 10 Drawing Figures

Fig. 1
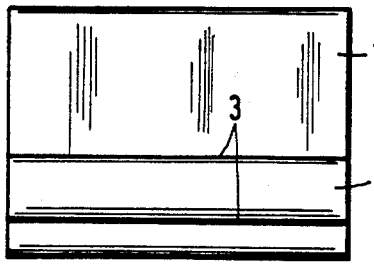
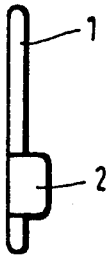
Fig. 2
Fig. 3
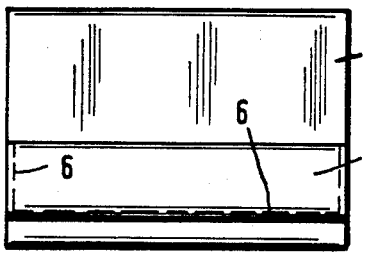
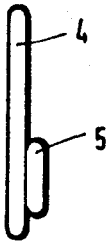
Fig. 4
Fig. 5
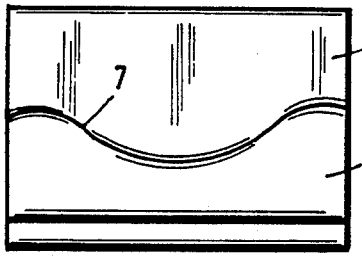
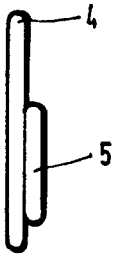
Fig. 6
FIG. 7
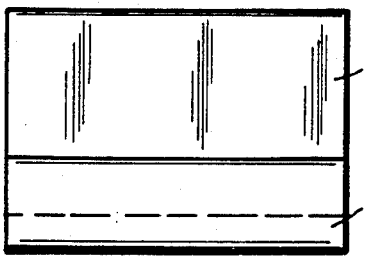
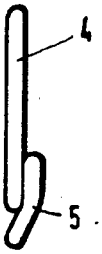
Fig. 8
Fig. 9
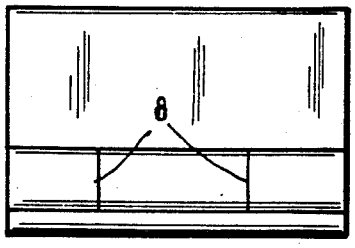
Fig. 10
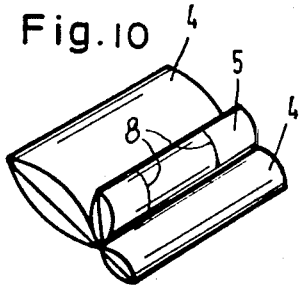

ORTHOPEDIC PILLOW

The invention relates to a orthopedic pillow for regenerating the spinal column in the region of the cervical vertebrae.

Work habits and lifestyles of the present day involve keeping the head and shoulders in a bent posture for long periods of time. This applies, for example, to all desk jobs and also to pupils, since the horizontal working surface forces the person concerned to adopt an intensified bent posture. Activities on the assembly line and in modern standing kitchens also necessarily result in relatively pronounced bending of the head, the bend usually occurring between the second and third cervical vertebrae. Bending of the lower cervical spinal column arises mostly in counter occupations, in work at data display units and the like. Finally, the present-day increased manual activity in all occupational groups makes it necessary to draw the shoulders forward, for example even for driving an automobile. These stereotyped bending positions lead to shortening of corresponding muscles, especially the head flexor muscles and the large chest muscle.

The object on which the invention is based is to provide a medical pillow which allows the region of the cervical vertebrae to be regenerated during sleep.

This object is achieved, according to the invention, due to the fact that the pillow has, in the lower part, especially at a distance from the bottom edge of the pillow, a larger thickness dimension than over the remaining pillow area.

The thickened region of the pillow ensures support especially for the upper and lower cervical spinal column, whilst the shoulders are supported by the bottom edge region of the pillow. This results in a slight expansion of the shortened muscle groups, so that the desired regeneration becomes possible during sleep.

Advantageous forms of the invention are indicated in the following description and in the sub-claims.

Exemplary embodiments of the invention are explained in more detail below with reference to the drawings in which:

FIG. 1 is a top plan view of a first embodiment of a pillow constructed in accordance with principles of the present invention; and FIG. 2 is a left side elevational view thereof.

FIG. 3 is a top plan view of a second embodiment of a pillow constructed in accordance with principles of the present invention; and FIG. 4 is a left side elevational view thereof.

FIG. 5 is a top plan view of a third embodiment of a pillow constructed in accordance with principles of the present invention; and FIG. 6 is a left side elevational view thereof.

FIG. 7 is a top plan view of a fourth embodiment of a pillow constructed in accordance with principles of the present invention;

FIG. 8 is a left side elevational view thereof;

FIG. 9 is a top plan view of a fifth embodiment of a pillow constructed in accordance with principles of the present invention; and FIG. 10 is a perspective view thereof.

In FIGS. 1 and 2, 1 denotes a rectangular pillow which has, at a short distance from the bottom edge, a thickened portion 2 which extends over the width of the pillow 1. In the embodiment according to FIGS. 1 and 2, the thickened portion is separated from the stuffing of the pillow 1 by quilting seams 3, the portion 2 having more stuffing.

In the embodiment according to FIGS. 3 and 4, there is a rectangular basic pillow 4 on which is sewn in the lower region a strip-shaped additional pillow 5 which forms the thickened region and which extends over the width of the basic pillow 4. This additional pillow 5 is preferably fastened to the basic pillow 4 in the lower region on the sides only, so that it cannot be displaced towards either of the two sides, but can indeed be displaced to some extent upwards and downwards. This makes it possible to adjust the pillow to the individual head position. There can be for this purpose a quilting seam 6 which (as represented by broken lines in FIG. 3) extends round the lower corners of the additional pillow 5.

The quilting seam for fastening the additional pillow is preferably designed as a loose quilting seam, so that adjustment of the pillow by displacing the additional pillow 5 in relation to the basic pillow 4 is assisted.

The basic pillow has preferred dimensions of 40 to 80 cm height and 60 to 80 cm width, whilst the additional pillow, with a width of 60 to 80 cm, has a height dimension of approximately 10 to 20 cm. The additional pillow 5 or the appropriately thickened portion 2 according to FIGS. 1 and 2 is arranged on the pillow in such a way that the bottom edge of the additional pillow or of the thickened region is preferably at a distance of approximately 5 cm from the bottom edge of the pillow.

The basic and additional pillows or the thickened portion can have the same stuffing and even different stuffings, for example a stuffing consisting of feathers, synthetic material or a mixture of these.

The additional pillow 5 appropriately has the same amount of stuffing as the basic pillow 4, so that twice as much stuffing or twice the total thickness of the pillow is obtained in the thickened portion as over the remaining pillow area.

During sleep, the region of the cervical vertebrae rests on the thickened portion 2 or the additional pillow 5, especially the upper and lower cervical spinal column being supported, whilst the shoulders are supported by the bottom, approximately 5 cm high edge portion of the basic pillow. This results in a slight expansion of the shortened muscle groups, whilst excessive expansion which would lead to painful stresses is avoided. Since bending and the drawing-forward of the shoulders occur to varying degrees in individual cases, the pillow described can be used in addition to the hitherto customary pillow, the thickness of which must be lessened correspondingly by reducing the stuffing.

The width of the pillow is such that it allows the head to turn comfortably towards each side, but it is not so wide that the arm lying above the head in a side position still rests on the pillow. This would lead to excessive expansion of the large chest muscle. The width of the pillow is therefore preferably 60 cm.

The height dimension of the pillow is such that the head, cervical spinal column and upper shoulder musculature, but not the shoulder itself, are supported. The squama occipitalis should rest approximately in the center of the pillow. Since the pillow stuffing is intended to give support in specific height portions, the individual portions need be displaced only a little in this direction. The distance between the shoulder and the occiput is approximately 15 cm. When the occiput is to rest in the center of pillow, the minimum height is therefore around 30 cm. However, since the head should maintain a minimum bent position which differs in individual cases, a displacement zone of approximately 10 cm is added for this purpose. This consequently results in the height dimension of 40 cm mentioned previously.

As regards the thickness dimension, in view of the S-shaped curvature of the occiput and the cervical and thoracic spinal column and the varying forms pronounced in individual cases, the stuffing is designed so that it supports the individual stages sufficiently, but allows small individual displacements. This is based on an upright free standing position of the body. In this position, the squama occipitalis is at a distance of 1 cm, the cervical spinal column a maximum of 3 cm and the top 5 cm of the thoracic spinal column again approximately 1 cm from the rear body perpendicular. Correspondingly, the pillow stuffing is designed so that the weight of the head compresses the stuffing in the center of the pillow to a thickness of approximately 1 cm. Since the weight of the approximately 10 cm long cervical spinal column (perpendicular) is lower it is sufficient if there is only twice as much stuffing in this region.

The distance between the upper shoulder and the seventh cervical vertebra is approximately 5 cm. Correspondingly, the thickened portion 2 or the additional pillow 5 is located at a distance of approximately 5 cm from the bottom edge of the basic pillow and forms a portion of 10 cm (perpendicular) with double the stuffing for supporting the cervical spinal column. The remaining height portion of the basic pillow of 25 cm (perpendicular) has the basic stuffing.

In the preferred embodiment of a basic pillow of 60×40 cm and an additional pillow fo 60×10 cm at a distance of 5 cm from the bottom edge of the basic pillow, the additional pillow 5 is sewn to the basic pillow at least in portions along the bottom edge, so as to allow displacement zones in the occipital region. This results in individual adjustment both to the different curvatures and the bending angle between the occiput and the cervical spinal column, together with the positional center of gravity of the occiput somewhat below the center of the pillow. In a position resting on the back, the bottom 5 cm high edge portion of the basic pillow supports the upper shoulder muscles, but not the shoulders themselves. In a position resting on the side, this lower portion is pushed upwards by the shoulder moving higher and thus helps to support the head which is higher in a side position and will therefore rest on the double-padded portion.

To make this possible even more effectively, in the embodiment according to FIGS. 5 and 6 the sewn-on additional pillow 5 or an appropriately thickened portion according to the embodiment of FIGS. 1 and 2 is widened upwards towards both sides from a height dimension of approximately 10 cm in the center to approximately 15 cm, and the edge 7 in the form of a wavy line, which is formed as a result, approximately follows the imprint of the borderline of the hair, as shown in FIG. 5. In this embodiment also, the bottom edge of the additional pillow 5 extends approximately parallel to the bottom edge of the basic pillow 4, since the correction is made in this region by the shoulders.

FIGS. 7 and 8 shows a modified embodiment in which the basic pillow 4 has a height dimension of approximately 35 cm with a width of 60 cm, whilst the additional pillow 5 has a height of approximately 15 cm with a width of 60 cm and is sewn on the lower portion of the basic pillow 4 so as to overlap in such a way that an edge portion of the additional pillow 5 with a height of approximately 5 cm is exposed, whilst the remaining 10 cm of the additional pillow 5 forms the thickened portion together with the bottom 10 cm high edge portion of the basic pillow 4. Because of this design, the additional pillow can be made easier to produce, since it has a larger height dimension. In this design, the additional pillow 5 is sewn on the basic pillow 4 at the side edges and at least partially along the bottom edge of the latter.

To make height adjustment easier, the quilting seam located at a distance of approximately 5 cm from the bottom edge of the pillow is designed as a loose quilting seam.

In the embodiment according to FIGS. 9 and 10, there are two quilting seams 8 which run approximately parallel to the side edges and which extend in the thickened portion or on the additional pillow 5 at a distance of approximately 15 cm from the side edge, so that an approximately 30 cm wide portion is obtained in the center. In this design, the lateral displacement of the stuffing is restricted and the pillow shape is stabilized thereby. In this embodiment also, the additional pillow designed in this way is preferably sewn on the basic pillow at the bottom only.

The seam, by means of which the additional pillow 5 is fastened to the bottom of the basic pillow 4, preferably extends through the basic pillow, so that the basic pillow is sub-divided into a 5 cm high portion at the bottom and a 35 cm high portion at the top, as shown in FIG. 10.

As a result of the pillow design according to the invention, on the one hand the cervical spinal column is supported, but on the other hand, because of the upper displacement zone in the region of the exposed top edge of the additional pillow, it becomes possible to ensure an offset head support and adjustment to an individual radius of curvature and bending angle of the occiput. A lower guideline for the prominent seventh cervical vertebra is provided for the position resting on the side. This guide likewise makes it more favorable for the head to move higher, a lower displacement zone being provided by the bottom 5 cm high edge portion of the basic pillow.

Various modifications of the design according to the invention are possible. Thus, the bottom edge portion of the basic pillow can be thickened over a height dimension of approximately 15 cm, this thickened portion terminating flat towards the bottom edge of the pillow or being provided with less stuffing.

A mixture of 70% polyester and 30% new sheep's wool is preferably provided as a stuffing for the basic and additional pillows.

The thickness dimension of the pillow can be, for example, 15 to 20 cm, and the portion provided for supporting the region of the cervical vertebrae is additionally 5 to 10 cm thick.

In the embodiment according to FIGS. 9 and 10, the middle portion between the two quilting seams 8 of the additional pillow or of an approximately designed portion is made movable relative to the basic pillow, so that displacement zones for the correct support of the head are obtained. It may be expedient to provide the three portions of the thickened portion, which emerge in the embodiment according to FIGS. 9 and 10, with different stuffings, in which case the stuffing the two outer portions is the same.

We claim:

1. An orthopedic pillow, comprising:

a generally rectangular main pillow portion having a stuffing with generally uniform thickness, this main pillow portion being bounded by an upper edge, a lower edge, and left and right side edges; and an additional pillow portion having a stuffing with generally uniform thickness. this additional pillow portion being bounded by an upper edge, a lower edge, and left and right edges;

said additional pillow portion being substantially shorter in the direction extending between the upper and lower edges thereof than is said main pillow;

means operatively connecting said additional pillow portion to said main pillow portion so that:

said left edge of said additional pillow portion at least generally coincides with said left edge of said main pillow portion throughout at least part of the extent of each, said right edge of said additional pillow portion at least generally coincides with said right edge of said main pillow portion throughout at least part of the extent of each, said upper edge of said additional pillow portion is located substantially down said main pillow portion from said upper edge of said main pillow portion; and said additional pillow portion, in a region extending substantially fully across the width thereof and throughout at least part of the height thereof in the direction extending between the upper and lower edges thereof is juxtaposed with said main pillow portion in such a manner as to provide a total pillow thickness throughout said region that is substantially greater than said generally uniform thickness of said main pillow portion;

said operatively connecting means comprising sewn seaming and said operatively connecting means leaves said additional pillow portion free of connection to said main pillow portion above the lower edge of said additional pillow portion, at least throughout a medial portion of said region having a substantial width;

said means operatively connecting said additional pillow portion to said main pillow portion additionally leaving said lower edge of said additional pillow portion located up said main pillow portion from said lower edge of said main pillow portion;

said main pillow portion and said additional pillow portion being constituted by respective separate pillows, with the latter being superimposed upon the former; and said additional pillow portion including left and right quilting seams applied through the thickness thereof extending approximately parallel to said left and right side edges thereof intermediate the width thereof bounding respective margins of said medial portion.

* * * * *